US006889685B2

(12) United States Patent
Dane

(10) Patent No.: US 6,889,685 B2
(45) Date of Patent: May 10, 2005

(54) GAS BURNER OF ATMOSPHERIC TYPE

(75) Inventor: Bernard Dane, Montbazon (FR)

(73) Assignee: Burner Systems International (BSI) (FR)

( * ) Notice: Subject to any disclaimer, the term of this patent is extended or adjusted under 35 U.S.C. 154(b) by 351 days.

(21) Appl. No.: 10/274,734

(22) Filed: Oct. 21, 2002

(65) Prior Publication Data

US 2003/0075164 A1 Apr. 24, 2003

(30) Foreign Application Priority Data

Oct. 24, 2001 (FR) ..... 01 13730

(51) Int. Cl.[7] ..... F26C 3/08
(52) U.S. Cl. ..... 126/39 B; 126/39 E; 431/354
(58) Field of Search ..... 126/39 E, 39 H, 126/39 K; 431/286, 350, 354; 239/559, 567

(56) References Cited

U.S. PATENT DOCUMENTS 4,757,801 A 7/1988 Le Monnier de Gouville et al.
5,133,658 A * 7/1992 Le Monnier De Gouville et al. ..... 431/349
5,209,217 A * 5/1993 Beach et al. ..... 126/39 R
5,213,091 A * 5/1993 Beach ..... 126/299 D
5,899,681 A * 5/1999 Maughan ..... 431/8
5,924,860 A * 7/1999 Massey et al. ..... 431/266
6,093,018 A * 7/2000 Avshalumov ..... 431/352

FOREIGN PATENT DOCUMENTS

EP 0994301 4/2000

* cited by examiner

*Primary Examiner*—Stephen Gravini
(74) *Attorney, Agent, or Firm*—DLA Piper Rudnick Gray Cary US LLP

(57) ABSTRACT

Atmospheric gas burner for a cooking appliance comprising: a burner head with a lateral perimeter wall defining a distribution chamber provided with flame orifices; a gas injector; means for conveying primary air to downstream of the injector; and a venturi directing the gas/air mixture towards the distribution chamber; at least one region of the lateral wall, free of flame orifices, is pierced with a through-aperture and a passage isolated from the distribution chamber is established in the burner head to connect the aperture to the injector, this aperture and this passage having cross sections which ensure a stream of primary air from the outside of the burner head with a flow rate appropriate to the operation of the burner.

8 Claims, 4 Drawing Sheets

GAS BURNER OF ATMOSPHERIC TYPE

FIELD OF THE INVENTION

The present invention relates to improvements made to gas burners of atmospheric type for cooking appliances, comprising

- a burner head with a lateral perimeter wall provided with flame orifices distributed peripherally and in communication with an interior chamber for distributing a gas/air fuel mixture,
- a gas injector,
- means for conveying primary air to downstream of the injector, and
- a venturi receiving the gas/air mixture and directing it towards said distribution chamber.

DESCRIPTION OF THE PRIOR ART

Such burners are customarily fitted to household or professional cooking appliances and can operate on various types of gaseous fuel such as town gas, natural gas and liquefied petroleum gas.

Gas burners of atmospheric type are arranged in such a way that the primary air needed to obtain good combustion arrives downstream of the gas injector to be mixed with the gas leaving the injector.

This primary air can be taken from under the hob or top plate: this is generally the case with burners equipped with a traditional venturi in biconical tubular form running horizontally (parallel to the top plate and transverse to the axis of the burner head) or vertically (coaxial with the axis of the burner head); this may also be the case with burners of the flat type in which the venturi is in radial annular form and housed in the burner head. However, in this configuration with primary air being supplied from under the hob, it is necessary for the appliance to be arranged accordingly and this may, in certain appliances, lead to a need to make large and therefore unattractive openings in the hob.

The primary air can also be taken from above the hob or top plate and may pass between the upper face of the hob and the burner head, the latter possibly or possibly not having a peripheral skirt: this is often the case for burners of extra-flat type with radial annular venturi built into the burner head. However, the annular gap defined between the top face of the hob and the burner head (or the skirt of the burner head) is also unattractive. This gap may also have a psychologically disturbing effect on the users because some users may not perceive it to be liquidtight (and may worry that the burner might be flooded).

SUMMARY OF THE INVENTION

The object of the invention is to attempt, as far as possible, to overcome the aforementioned disadvantages of the various known atmospheric-burner arrangements and to propose a novel technical solution which, while maintaining correct burner operation regardless of the power and arrangement of the burners, allows a sealed and attractive burner to be produced without this also resulting in a significant additional cost in the manufacture of the burners or in their upkeep.

To these ends, the invention provides a gas burner of atmospheric type as set out in the preamble wherein at least one region of said lateral wall is free of flame orifices and wherein the means for conveying primary air to downstream of the injector comprise

- at least one through-aperture situated in the said region of the lateral wall which is free of flame orifices and
- a communication passage made in the burner head and isolated from the distribution chamber, to place the said aperture in communication with the injector,
- the said aperture and the said passage having respective cross sections able to allow primary air to flow from the outside of the burner head towards the injector with a flow rate appropriate to the operation of the burner.

As a preference, each primary air inlet aperture lies at a level below that of the flame orifices, so that the aperture is functionally separated from the flame orifices and so that the primary air entering the aperture is not mixed with the products of combustion and does not carry away a fraction of them (or not to any significant extent). According to one simple embodiment which can be implemented when the burner head is closed at the top by a removable cap, each primary air inlet aperture is formed by a notch running from the upper edge of the lateral wall of the burner head, the bottom of the said notch being situated lower down than the bottom of the notches that form the flame orifices.

According to one arrangement which is simple to produce whatever the power, and therefore the diameter, of the burner, the aforementioned passage associated with the aperture is defined by a partition internal to the burner head, which is curved and rests against the lateral wall, surrounding said through-aperture. In this case, when the burner comprises a radial annular venturi built into the burner head, said passage forms a well internal to the burner head which runs between said aperture and, via an elbowed part, the injector. When the burner comprises a biconical tubular venturi (horizontal or vertical) external to the burner head, said passage forms a well internal to the burner head which is open at the bottom towards the outside of the burner head through the bottom thereof, the primary air then, having left said well, circulating in the space defined in the cooking appliance between the top plate or hob and a bottom plate which closes off the cooking appliance at the bottom and separates it, for example, from another household appliance or an underlying cupboard.

Although there may be any number of primary air inlet apertures, or even just one, provided the total cross section offered to the flow of primary air is sufficient to obtain correct burner operation, in practice there are between 2 and 8 primary air inlet apertures. In a typical embodiment, there are four primary air inlet apertures offset by approximately 90° from each other, and that is true whatever the power of the burner; what is more, to make manufacture even simpler, provision is made for all the apertures to have the same cross section and the same shape for all burners of various powers, this cross section and this shape being determined on the basis of the highest requirements, that is to say on the basis of the requirements of the most powerful burner of a range of burners.

Thanks to the arrangements according to the invention, a gas burner is produced which, to operate, requires no opening or gap of any nature or location whatsoever at the hob: since the apertures are situated heightwise on the wall of the burner head, the burner is therefore perfectly sealed. The means provided by the invention are suitable for all types of atmospheric burners and may give rise to a single configuration for burners of all types and all powers, and therefore of all sizes. This results in an atmospheric burner arrangement which is visually appealing and which does not give cause for concern, even groundless concern, in the users. Furthermore, burner operation is not affected by the arrangements according to the invention.

BRIEF DESCRIPTION OF THE DRAWINGS

The invention will be better understood from reading the detailed description which follows of certain preferred embodiments which are given solely by way of entirely non-limiting examples. In this description, reference is made to the appended drawings, in which.

DETAILED DESCRIPTION OF THE INVENTION

The means employed according to the invention consist in a particular arrangement of the head of an atmospheric burner so that the primary air is conveyed towards the gas injector, whatever the location thereof, having been taken through the lateral perimeter wall of the burner head. In other words, according to the invention, apertures or openings are made in the upper part of the burner head, these being carefully positioned in regions free of main flames and situated at a chosen level so that the primary air drawn through these apertures is not contaminated by the products of combustion of the main flames. There may be any number of these apertures or openings, considering that the total cross section offered to the passage of the primary air has to allow an air flow rate able to ensure that the combustion criteria are adhered to in accordance with the legal requirements in force.

Thus, the burner now includes all the fuel and oxidant supply means, whereas hitherto, the supply of the burner with primary air could be dependent only on the layout of the cooking appliance.

The arrangements of the invention will now be explained in the context of three specific exemplary embodiments of an atmospheric gas burner.

Figure 1:
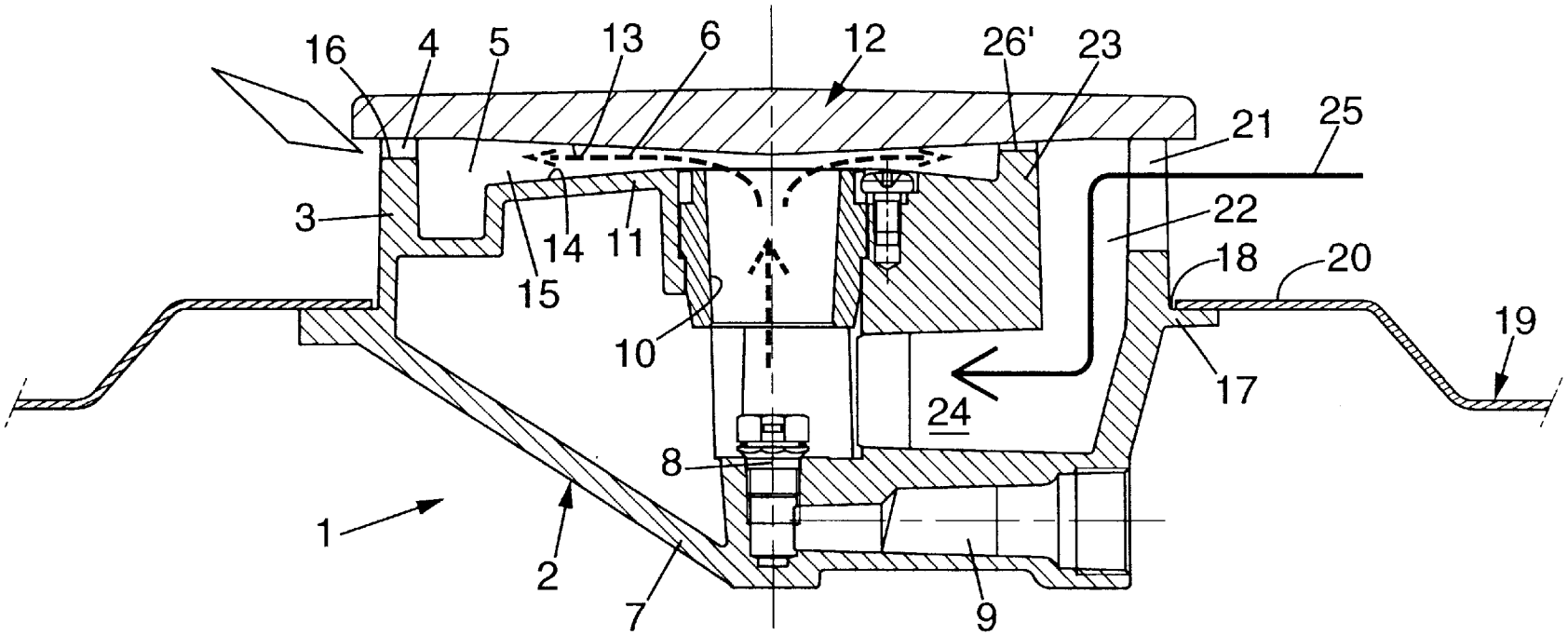
FIG. 1 is a side view, in section on line I—I of FIG. 3, of a gas burner of flat type, with radial annular venturi built into the burner head, and which is arranged according to the invention.
Figure 3:
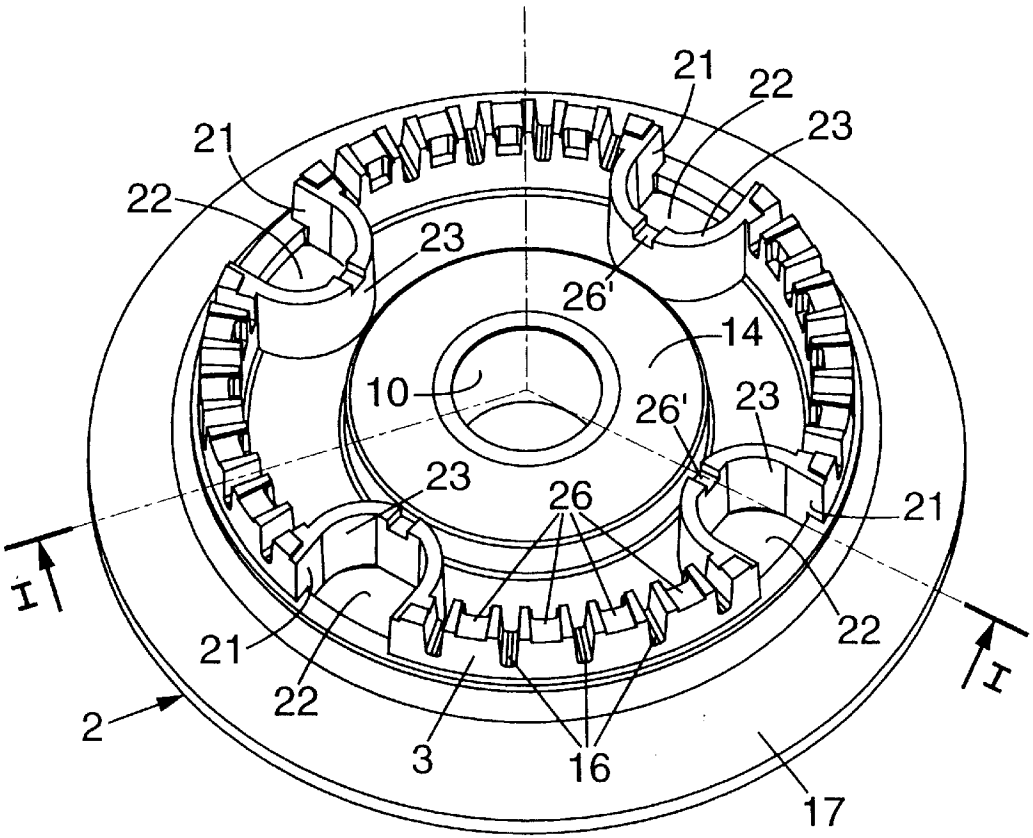
FIG. 3 is a perspective view of a preferred embodiment of a burner head which can be used to form the burner of FIG. 1.
Figure 2:
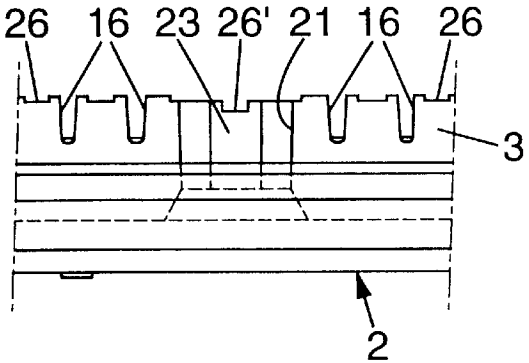
FIG. 2 is a side view of a part, laid out flat, of the lateral wall of the head of the burner of FIG. 1.

Referring first of all to FIGS. 1 to 3, we will first of all explain the invention in the context of the layout of a burner of flat or extra-flat type with radial annular venturi.

In FIG. 1, an atmospheric gas burner 1 comprises a burner head 2 having a lateral perimeter wall 3 provided with flame orifices 4 distributed peripherally and in communication with an interior chamber 5 for distributing a gas/air fuel mixture (depicted schematically by dashed arrows 6). The burner head 2 also comprises a bottom 7 made integrally with the lateral perimeter wall 3 (pot-shaped burner head), the said bottom 7 being arranged to support a gas injector 8 of vertical axis and to define a horizontal fitting 9 for connection to a gas supply tube (not shown). Running above the injector 8 and coaxially therewith is a vertical central passage 10 which, at the top, opens to the centre of a transverse plate 11 connecting peripherally to the lateral perimeter wall 3. Above the plate 11 there runs a cap or cover 12 resting removably on the top of the lateral perimeter wall 3.

The faces 13 of the cap 12 and 14 of the plate 11 which face each other near the periphery of the upper orifice of the central passage 10 diverge from one another radially outwards, thus forming an annular radial venturi 15.

The external annular parts which face each other, belonging to the cap 12 and to the plate 11 define, with the lateral perimeter wall 3, the aforementioned distribution chamber 5 of annular shape into which the annular venturi 15 opens.

The upper edge of the lateral perimeter wall 3 is equipped with a number of through-slots 16 which, closed at the top by the cap 12, form the aforementioned flame orifices 4.

The burner head 2 is equipped with fixing means 17 (for example a radially protruding annular flange or protruding tabs) able to allow it to be fixed (for example by screws) to the periphery of an orifice 18 in a hob or top plate 19 of a cooking appliance, through which orifice 18 the upper part of the burner head is engaged and projects above the top plate 19 (which may, at this point, be shaped locally into a dome 20 surmounting the remainder of the plate).

A partial side view, from the outside and laid out flat, of the burner head 2 is given in FIG. 2, in which the slots 16 are clearly visible.

According to the invention, at least one region of the lateral perimeter wall 3 is free of flame orifices, and means for conveying primary air to downstream of the injector 8 (that is to say into the jet gas leaving the injector) comprise at least one through-aperture 21 situated in the said region of the wall 3 that is free of flame orifices. A communication passage 22 is established inside the burner head 2 and behind the said aperture 21, isolated from the distribution chamber 5, so as to establish communication between the said aperture 21 and the injector 8. As is visible in FIG. 3, the passage 22 is delimited by a partition 23 internal to the burner head, curved in a circular arc and resting against the lateral wall 3, surrounding the aforementioned aperture 21. Thus formed, the passage 22 is in the form of a well internal to the burner head, stretching vertically along the lateral wall 3 and extending downwards in an elbowed fashion towards the injector by way of a radial duct 24.

In FIG. 1, the path of the primary air stream is depicted schematically by the arrow 25.

To avoid the products of combustion of the adjacent flames being carried along by the primary air drawn in through the aperture 21, the air inlet aperture 21 is offset and lies at a level below that of the flame orifices. In the embodiment of the burner 1 illustrated in FIGS. 1 to 3 with a removable cap 12, the aperture 21 is formed, in the same way as the aforementioned slots 16, by a notch running vertically from the upper edge of the lateral wall 3, the bottom of the said notch lying appreciably lower down than the bottom of the slots 16, as can be seen clearly in FIG. 1.

There may be any number of apertures 21, although an excessive number of such apertures 21 would excessively reduce the number of flame orifices. Furthermore, a single aperture would need to have a large passage cross section and the vertical passage 22 associated with it would be difficult to house locally within the burner head. In practice, it is reckoned that there be between 2 and 8 apertures, preferably in opposing pairs.

In addition, it is reckoned that there should be a low number (for example two) of apertures in a low-power (for example 0.5 kW), and therefore small-diameter, burner, whereas a high-power (for example 3.50 kW), and therefore large-diameter, burner should be provided with a high number (for example 6 or 8) of apertures.

However, manufacturing may be simplified by combining the following solutions:

all the burners, irrespective of their power, have the same number of apertures;

there are four apertures, offset from each other by about 90°;

all the apertures have the same cross section.

It is this arrangement which is illustrated in FIG. 3.

It will also be emphasized that, for the burner to be supplied correctly with primary air and to operate normally, it is necessary for the aperture 21, the well 22 and the radial duct 24 to have approximately the same cross section so that the primary air stream 25 is not slowed in its path toward the injector.

In addition, and still for the same reason, it is necessary for all of the apertures 21, all the wells 22 and all the radial ducts 24 to define a total cross section that is sufficient for the primary air to be able to arrive downstream of the injector with the appropriate flow rate in relation to the flow rate of the jet of gas delivered by the injector.

In the configuration illustrated in FIG. 3, all the apertures are identical irrespective of the power of the burner: the cross section of the apertures 21 is then defined on the basis of the primary-air requirements of the highest-power burner in the range. In a typical exemplary embodiment, the most powerful burner in a burner range for cooking appliances has a power of 3.5 kW. To obtain a primary aeration rate equivalent to at least 50% of the stoichiometric value of butane gas, the area of each of the four apertures 21 needs to be at least 120 $mm^2$.

Finally, it will be seen that, in the embodiment illustrated in FIGS. 1 to 3, the upper edge of the lateral perimeter wall 3 is, in the spaces between the slots 16 that define the flame orifices 4, equipped with small through-slots 26 of shallow depth; to complement this, the upper edge of the curved walls 23 is equipped with at least one small similar slot 26'; the small slots 26, 26' are intended to ensure propagation of the main flames around the periphery of the burner head particularly when the burner is lit.

As will be understood from the foregoing description, the arrangements according to the invention anticipating a primary air supply incorporated into the burner head are not specifically inherent to the type of burner with radial annular venturi which has been considered in more particular detail: the arrangements according to the invention may also be employed in burners equipped with a biconical tubular venturi, either horizontal or vertical.

Figure 4:
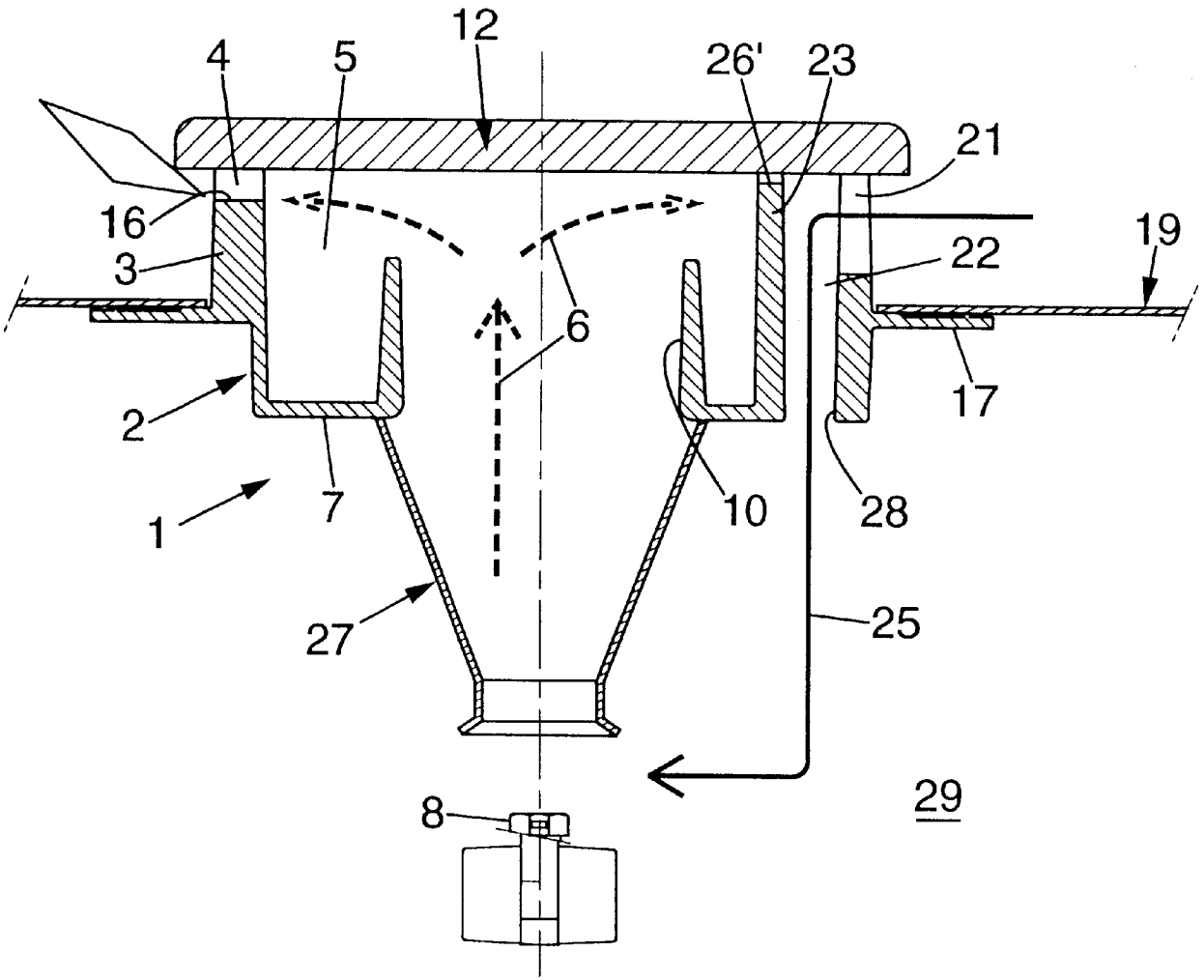
FIGS. 4 and 5 are side views, in section, of two gas burners with conical tubular venturi, vertical and horizontal respectively, which are arranged according to the invention.

FIG. 4 of the appended drawings very schematically illustrates a burner with a vertical venturi (the same numerical references have been kept for denoting the components or parts similar to those of FIGS. 1 and 3). The burner in FIG. 4 differs mainly from that of FIG. 1 in the arrangement of the venturi: the lateral perimeter wall 3 and the bottom 7 define a distribution chamber 5 of annular shape, surrounding a vertical central passage 10 through which the gas-air mixture arrives (dashed arrow 6). Under the bottom 7 and coaxial with the central well 10 is arranged a convergent-divergent vertical tubular portion 27 forming a venturi, under the orifice of which, at a distance and coaxial therewith, is arranged a vertical gas injector 8.

Just as in the burner head 2 of FIG. 1, the lateral wall 3 comprises at least one region which is free of slots 16 that form flame orifices 4 and in which there is an aperture 21 of large cross section which, at the rear (that is to say on the inside of the burner head), opens into a vertical well 22 defined by a vertical partition 23, for example of rounded shape, resting against the rear face of the lateral wall 3. In practice, the previously described arrangements on this subject are used again, and the arrangement illustrated in FIG. 3 is kept (except as far as the configuration of the venturi is concerned).

At the bottom, the well 22 opens, via an orifice 28 in the bottom 7 of the burner head, to the outside of the burner head.

This being the case, the stream of primary air (arrow 25) passes through the aperture 21, travels through the well 22, then, via the orifice 28, enters the space 29 underlying the hob 19 (which space is closed on the bottom, for example by a bottom plate, not shown), thus supplying the outlet of the injector 8 where it mixes with the jet of gas.

Figure 5:
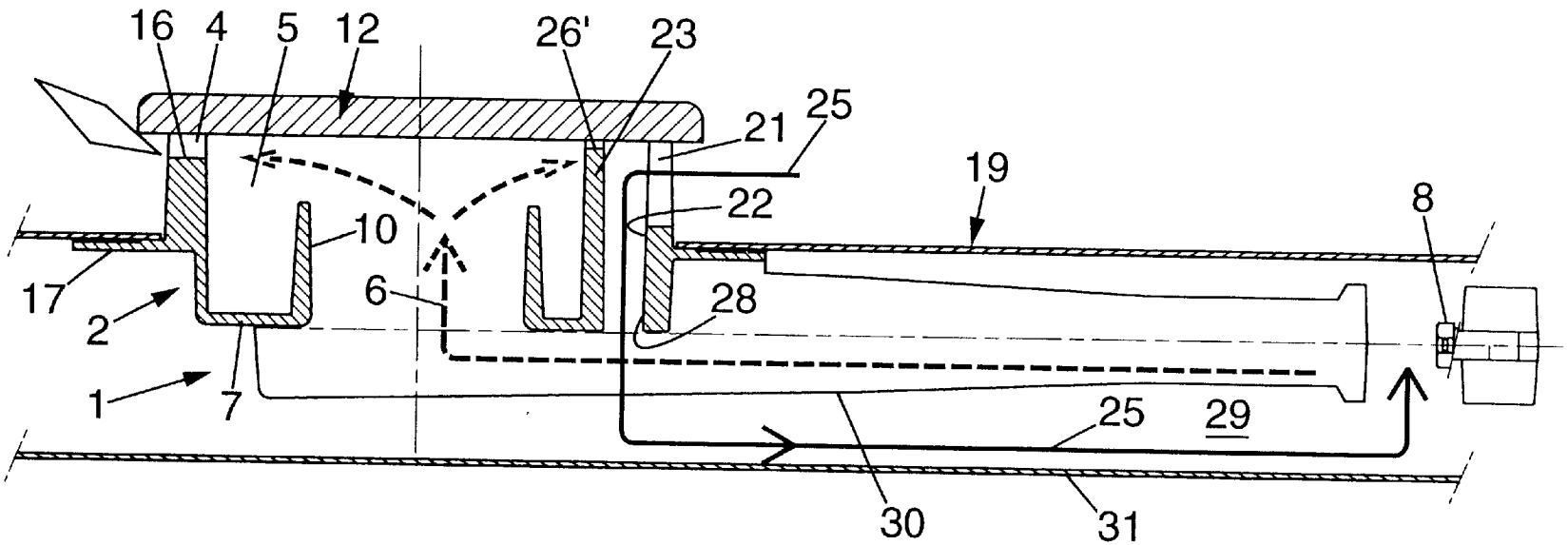

The same explanations remain valid for the burner illustrated in FIG. 5, which shows a burner similar to that of FIG. 4, except for the venturi which, in this instance, is of the horizontal type. This being the case, under the bottom 7 of the burner head 2 there runs a horizontal tubular portion 30 of convergent-divergent configuration forming a venturi at the end of which there is arranged, at a distance and coaxial therewith, a gas injector 8 of horizontal axis (it will be noted that, in FIG. 5, the venturi 30 and the injector 8 are situated not in the plane of section but behind it).

This being the case, the stream of primary air 25 opens via the lower orifice 28 of the well 22 into the intermediate space 29 lying between the hob 19 and the bottom plate 31, where it supplies the outlet of the injector 8.

Here again, in practice, the arrangement of the burner head 2, as far as the passage for the primary air is concerned, repeats the arrangements visible in FIG. 3.

What is claimed is:

1. A gas burner of atmospheric type for cooking appliance, comprising a burner head with a lateral perimeter wall provided with flame orifices distributed peripherally and in communication with an interior chamber for distributing a gas/air fuel mixture, a gas injector, means for conveying primary air to downstream of the injector, and a venturi receiving the gas/air mixture and directing it towards said distribution chamber, wherein at least one region of said lateral wall is free of flame orifices, and wherein the means for conveying primary air to downstream of the injector comprise at least one through-aperture situated in the said region of the lateral wall which is free of flame orifices and a communication passage made in the burner head and isolated from the distribution chamber, to place the said aperture in communication with the injector, the said aperture and the said passage having respective cross sections able to allow primary air to flow from the outside of the burner head towards the injector with a flow rate appropriate to the operation of the burner.

2. The gas burner according to claim 1, wherein each primary air inlet aperture lies at a level below that of the flame orifices.

3. The gas burner according to claim 2, in which the burner head is closed at the top by a removable cap, wherein each primary air inlet aperture is formed by a notch running from the upper edge of the lateral wall of the burner head, the bottom of the said notch being situated lower down than the bottom of the notches that form the flame orifices.

4. The gas burner according to claim 1, wherein said passage is defined by a partition internal to the burner head, which is curved and rests against the lateral wall, surrounding said through-aperture.

5. The gas burner according to claim 4, comprising a radial annular venturi built into the burner head, wherein said passage forms a well internal to the burner head which runs between said aperture and the injector.

6. The gas burner according to claim 4, comprising a tubular venturi external to the burner head, wherein said passage forms a well internal to the burner head which is open at the bottom towards the outside of the burner head through the bottom thereof.

7. The gas burner according to claim 1, wherein there are between 2 and 8 primary air inlet apertures.

8. The gas burner according to claim 7, wherein there are four primary air inlet apertures offset by approximately 90° from each other.

* * * * *